US011845197B2

(12) United States Patent
Makrygeorgou et al.

(10) Patent No.: US 11,845,197 B2
(45) Date of Patent: Dec. 19, 2023

(54) ENVIRONMENTALLY FRIENDLY OLIVE LEAF PANELS

(71) Applicants: Alexandra Makrygeorgou, Kato Ovria Patra (GR); Christos Lampropoulos, Kato Ovria Patra (GR)

(72) Inventors: Alexandra Makrygeorgou, Kato Ovria Patra (GR); Christos Lampropoulos, Kato Ovria Patra (GR)

( * ) Notice: Subject to any disclaimer, the term of this patent is extended or adjusted under 35 U.S.C. 154(b) by 0 days.

(21) Appl. No.: 15/734,267

(22) PCT Filed: May 29, 2019

(86) PCT No.: PCT/GR2019/000038
§ 371 (c)(1),
(2) Date: Dec. 2, 2020

(87) PCT Pub. No.: WO2019/234460
PCT Pub. Date: Dec. 12, 2019

(65) Prior Publication Data

US 2021/0213640 A1 Jul. 15, 2021

(30) Foreign Application Priority Data

Jun. 5, 2018 (GR) ..... 20180100243

(51) Int. Cl.
*E04C 2/16* (2006.01)
*B27N 1/02* (2006.01)
*B27N 3/02* (2006.01)

(52) U.S. Cl.
CPC ..... *B27N 1/02* (2013.01); *B27N 3/02* (2013.01); *E04C 2/16* (2013.01)

(58) Field of Classification Search
CPC ..... B33Y 70/00; E04C 2/16; B29C 64/00
See application file for complete search history.

(56) References Cited

U.S. PATENT DOCUMENTS 3,277,129 A * 10/1966 Menachem et al. ..... D01C 1/02 554/19
4,609,513 A * 9/1986 Israel ..... B27N 3/083 264/109

(Continued)

FOREIGN PATENT DOCUMENTS

DE 102008047574 A1 3/2010
ES 2006884 A6 5/1989

(Continued)

OTHER PUBLICATIONS

International Search Report of PCT/GR2019/000038, Search completed on Sep. 6, 2019, Authorized officer Guido Saretta, 3 pages.

*Primary Examiner* — Andrew D Graham
(74) *Attorney, Agent, or Firm* — DP IP GROUP; Franco S. De Liguori

(57) ABSTRACT

It is the creation of a new material derived from a mixture of renewable natural raw materials, i.e. dried leaves (whole and/or broken—crushed and/or powdered (granulated)) olives (whole and/or part of it and/or specific varieties), as well as inorganic and/or organic and/or synthetic adhesives. The whole mixture that is created undergoes some kind of pressure—depending on its use. Not only can it be used throughout the process but it can also function as a substrate—of varied materials—in all dimensions and shapes. The invention is a new environmentally friendly-partially or fully biodegradable-material that boasts great mechanical strength and resistance to ultraviolet radiation and moisture. This invention has the potential to be used as a flat and/or a three-dimensional surface (substrate part and/or entirely) in goods, works, products and structures for interior and/or exterior use, as a decorative material, a fine art and aesthetic material as well as for the manufacture of objects (general and/or special use).

14 Claims, 10 Drawing Sheets

(56) References Cited

U.S. PATENT DOCUMENTS 4,752,637 A * 6/1988 Israel ..... B27N 3/083 524/702
6,740,342 B1 * 5/2004 Hulst ..... D01B 1/42 426/489
8,246,733 B2 * 8/2012 DeBrouse ..... C09D 5/18 106/18.11
8,916,179 B2 * 12/2014 Axelrod ..... A23K 10/12 424/401
9,096,465 B2 * 8/2015 Tuttle ..... B32B 5/024
10,023,778 B2 * 7/2018 Chirdon ..... C09J 189/04
10,745,563 B2 * 8/2020 Eberts ..... B27N 3/00
2008/0193785 A1 * 8/2008 Kingma ..... B05D 7/08 428/541
2011/0065825 A1 * 3/2011 Lambert ..... A61L 31/041 522/111
2011/0271616 A1 * 11/2011 Rasmussen ..... B32B 21/14 52/220.1
2011/0293876 A1 * 12/2011 Rasmussen ..... B32B 5/02 442/152
2012/0070609 A1 * 3/2012 Poppe ..... B32B 29/002 428/95
2013/0085211 A1 * 4/2013 Baxter ..... C08L 61/06 524/10
2013/0276363 A1 * 10/2013 Heimann ..... C10L 5/44 44/577
2016/0038611 A1 * 2/2016 Vile ..... A61K 36/73 424/499
2016/0237328 A1 * 8/2016 Doisneau ..... B27N 3/00
2016/0289130 A1 * 10/2016 Innes ..... A01G 24/44
2019/0112512 A1 * 4/2019 Doisneau ..... C09J 5/00
2020/0128816 A1 * 4/2020 Thorvaldsdottir ..... A01N 3/00

FOREIGN PATENT DOCUMENTS

WO 97/38834 A1 10/1997
WO 2018/029496 A1 2/2018

* cited by examiner

ENVIRONMENTALLY FRIENDLY OLIVE LEAF PANELS

Figure 1:
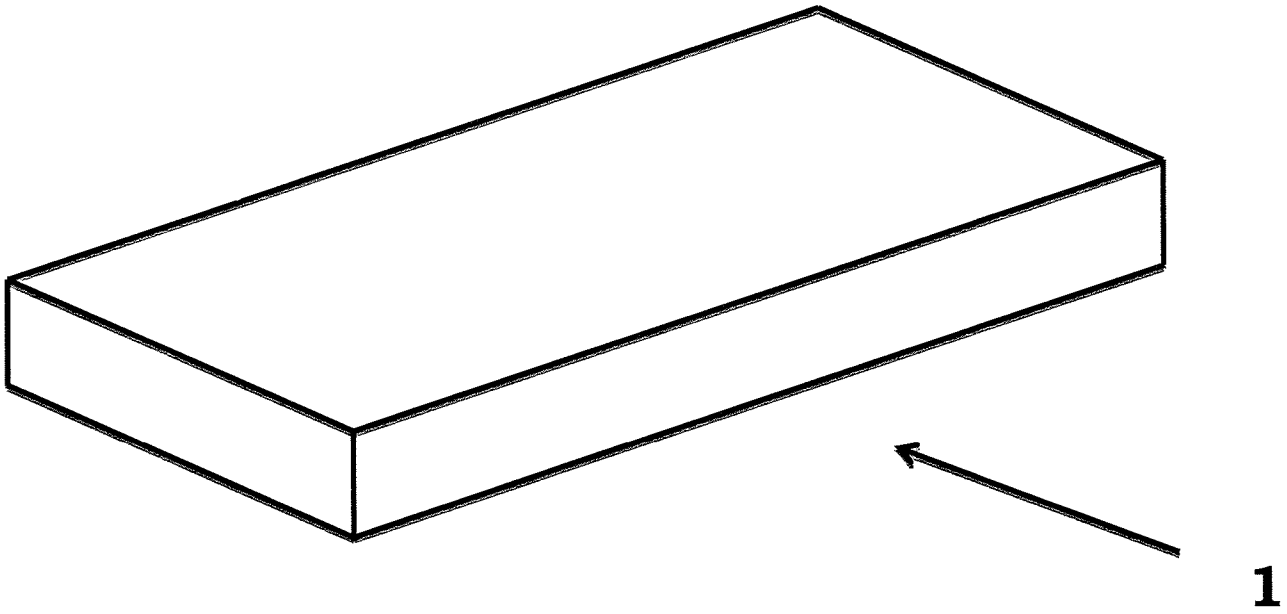

This invention focuses on the production of flat or/and three-dimensional panels made from the olive leaf biomass (FIG. 1).

Clarifications of Terminology—Concepts

The aforementioned terms, as well as the concepts referred to in the present invention, specify the following:

a) The term "panel" includes both flat surfaces and three dimensional surfaces (3D—3 Dimensional).
b) The term olive tree (*Elaea, Olea*) refers to the fruit tree of the Oleaceae family and includes all and/or part and/or a specific variety (e.g. *Olea sylvestris*) European {*Olea europaea*}, Spanish {*Olea hispanica*}, etc.)
c) The term olive leaves refers to dried, green and/or dead olive leaves.
d) The composition of the mixture is basically whole and/or broken—crushed and/or powdered olive leaves (granules).

Therefore, it is not necessary to completely refer to the term unless the inventors wishes to specify a particular feature.

CLARIFICATIONS OF FIGURES

FIG. 1: Panels made of a mixture of olives leaves, moisture and inorganic and/or organic adhesives (1).

Figure 2:
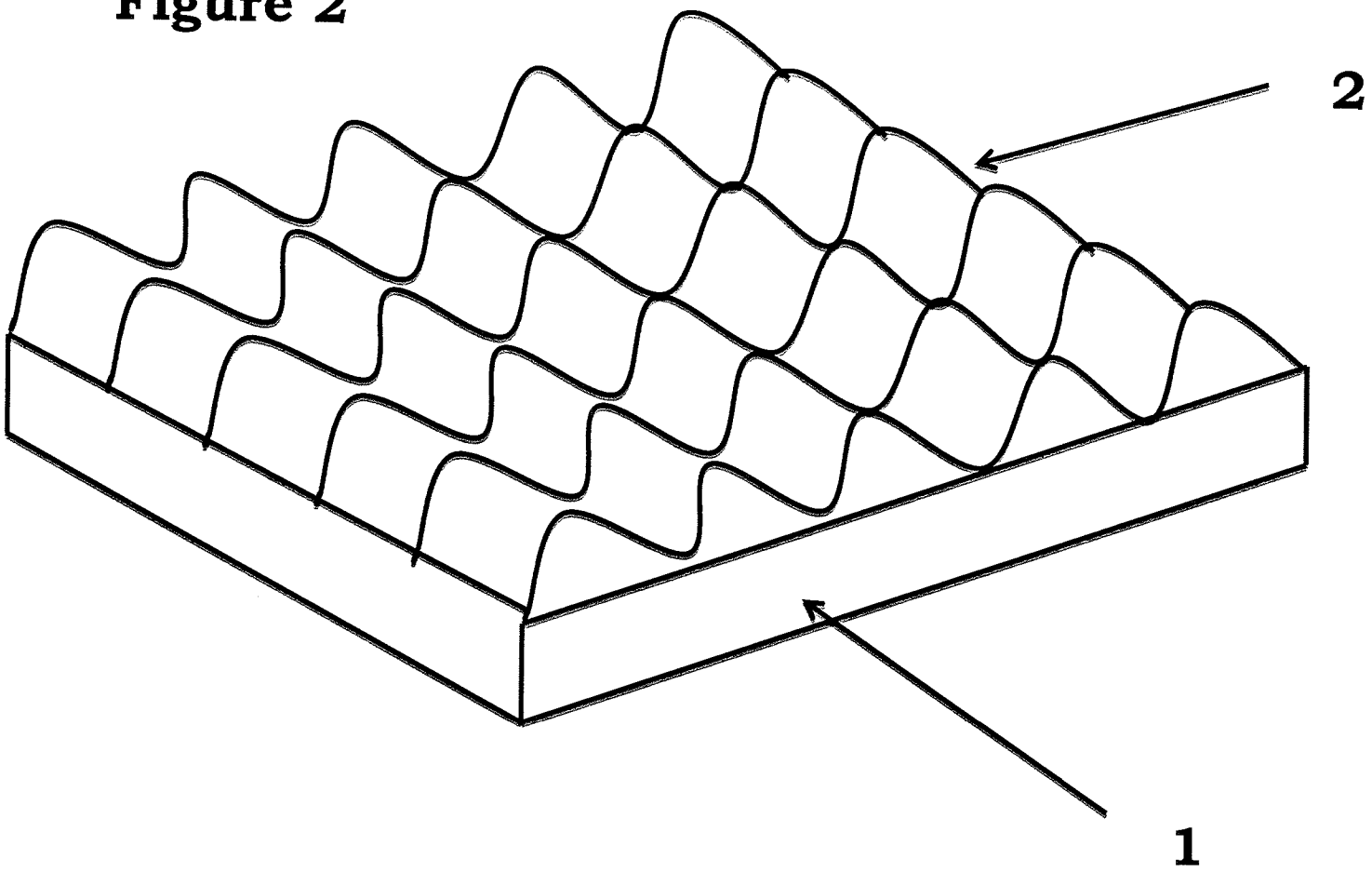

FIG. 2: Panels made of a mixture of olives leaves, moisture and inorganic and/or organic and/or synthetic adhesives (1) with a custom-designed or three dimensional surface (2).

Figure 3:
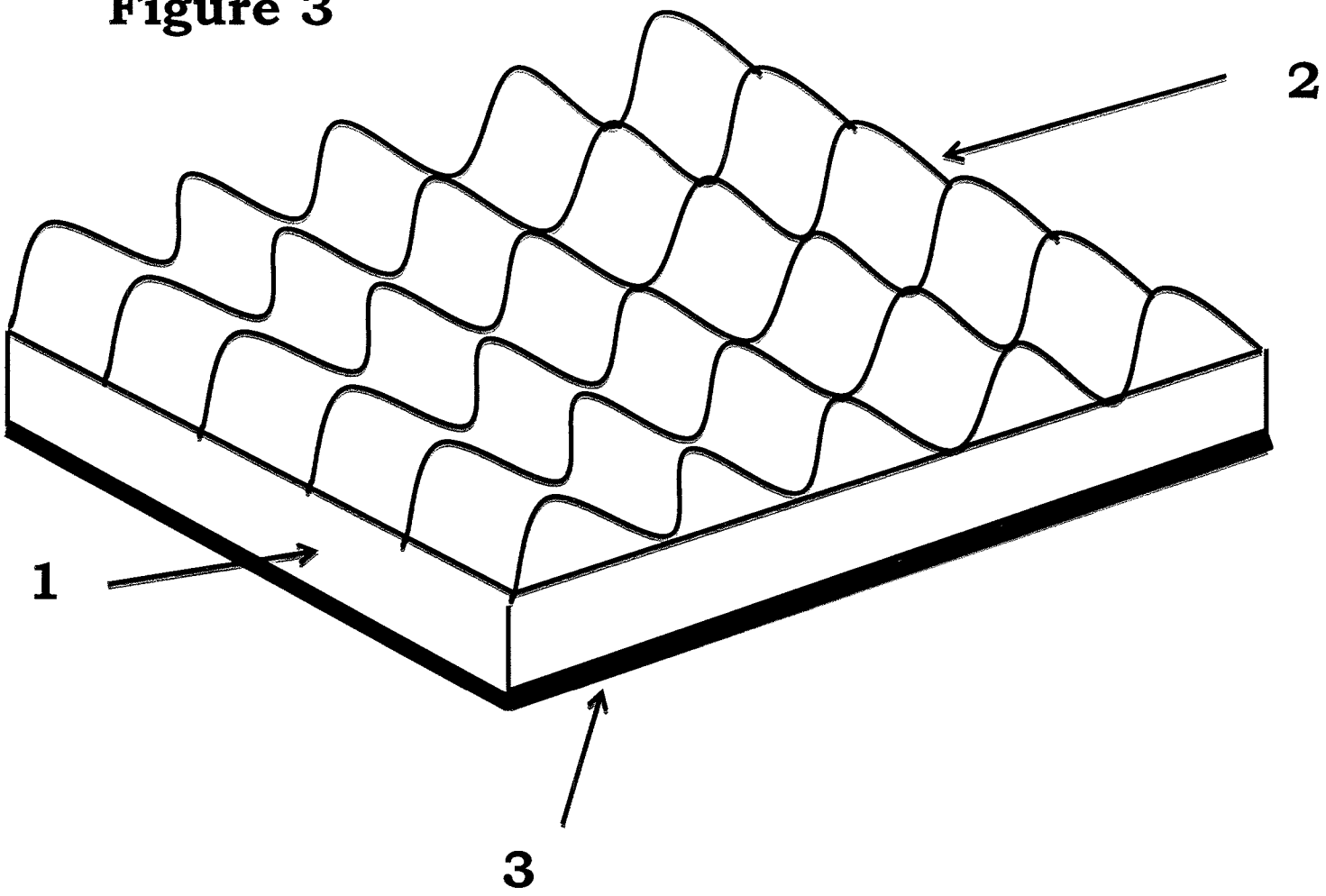

FIG. 3: Olive leaf panels with a custom-designed or three dimensional surface at the top (2) and having a substrate base (3) for the mixture (1).

Figure 4:
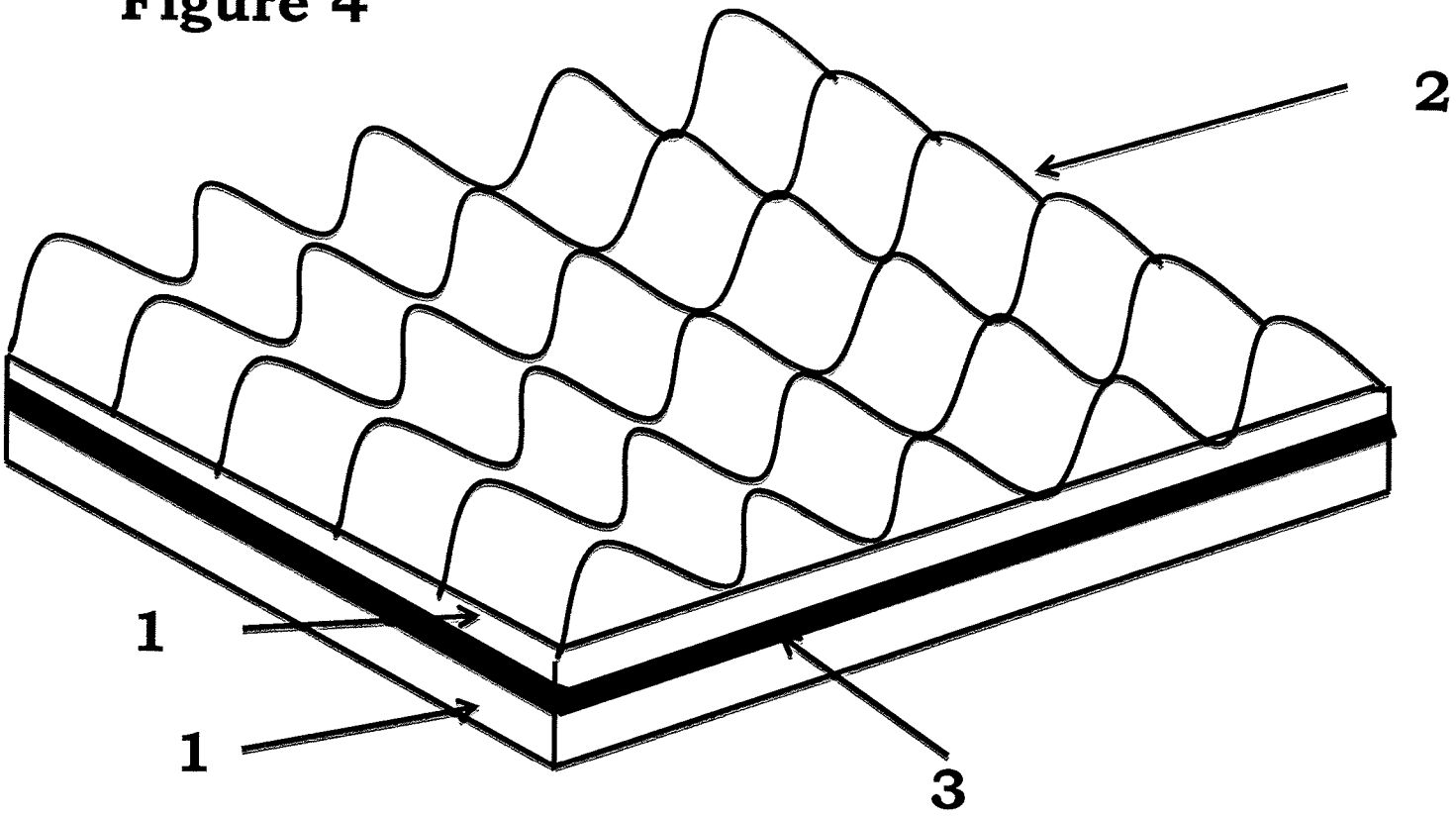

FIG. 4: Olive leaf panels with a custom-designed or three dimensional surface at the top (2) with a mixture underneath (1) in which there is an integrated substrate (3).

Figure 5:
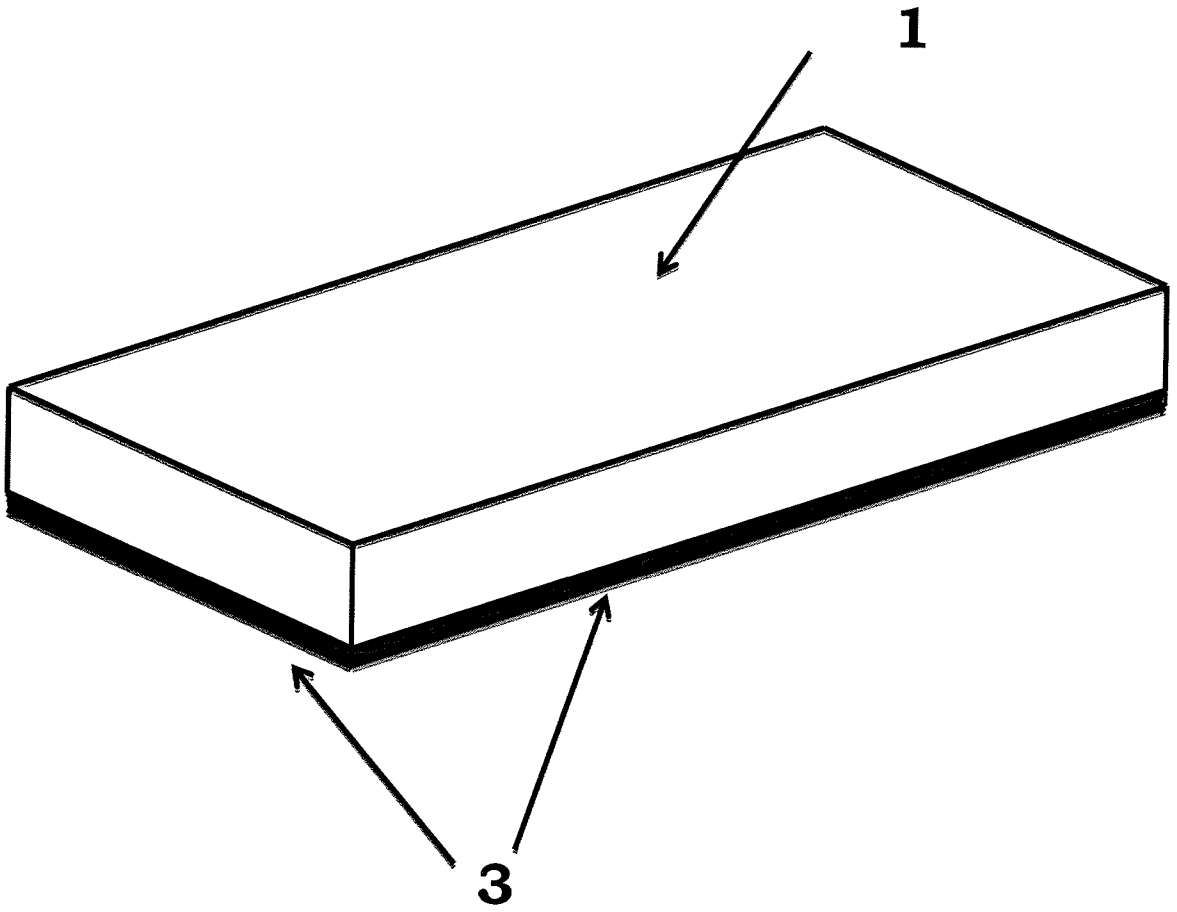

FIG. 5: Olive Leaf Panels with a substrate, where all the mixture (1) is supported either on the top or the bottom (3).

Figure 6:
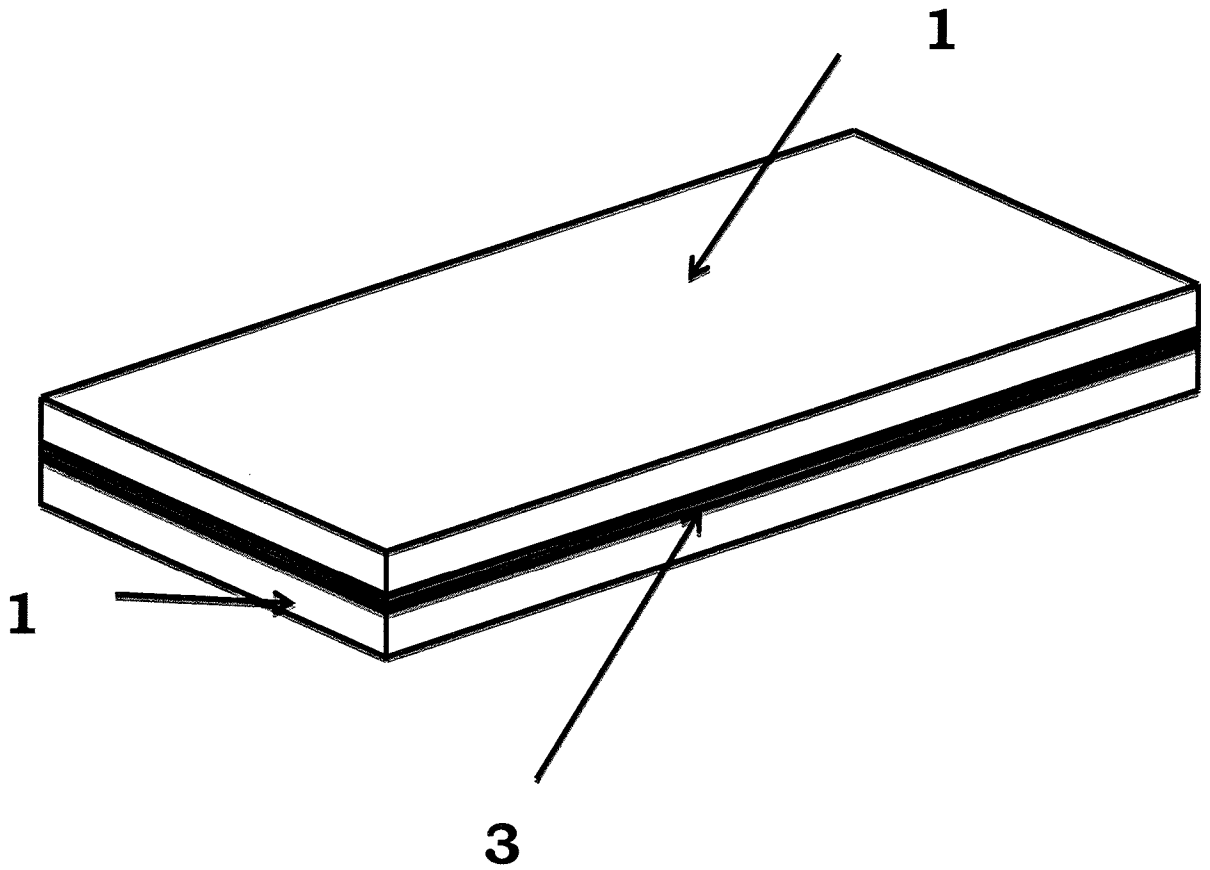

FIG. 6: Olive Leaf Panels wherein the mixture (1) constitutes the upper and lower surfaces within which there is an integrated substrate (3).

Figure 7:
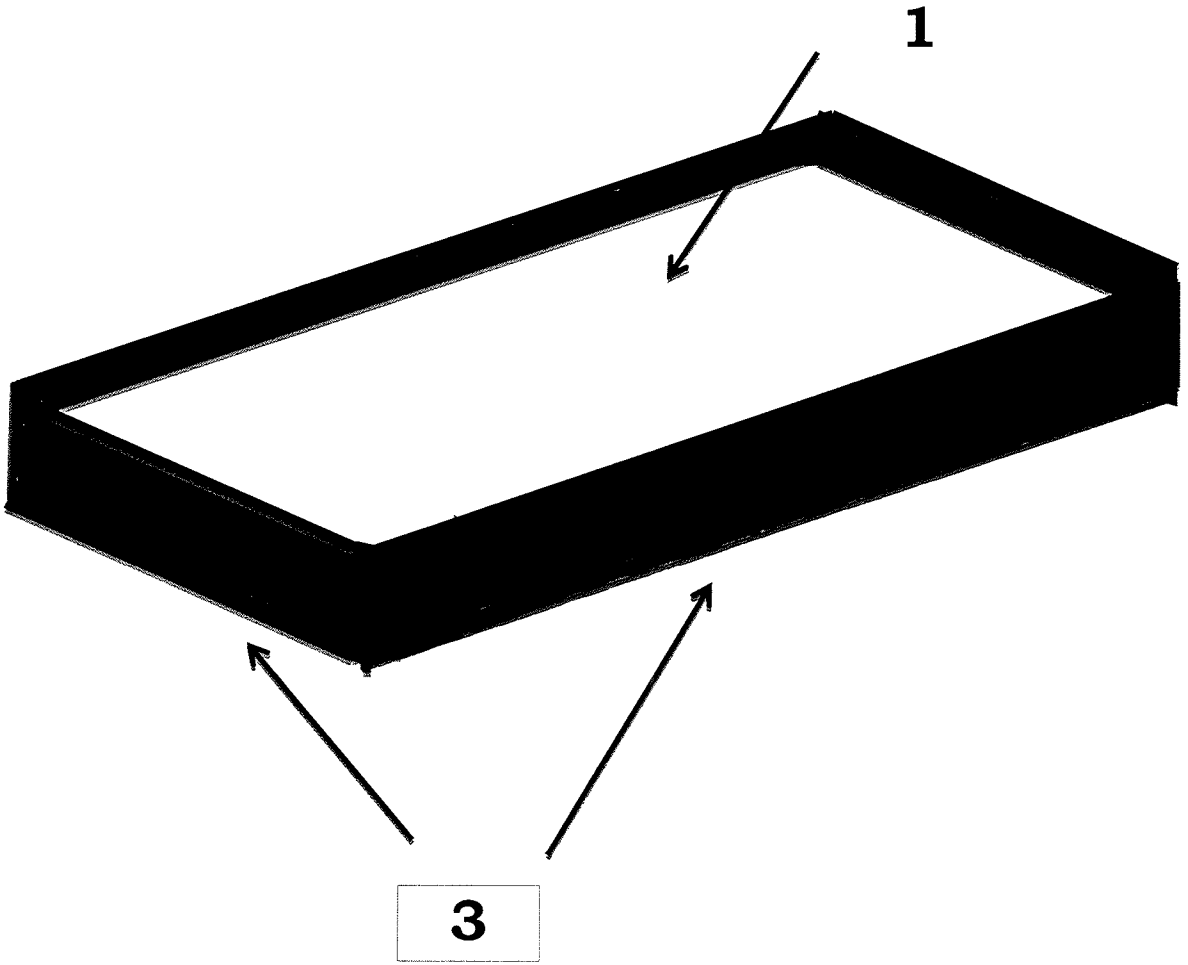

FIG. 7: Olive Leaf Panels in which the entire mix (1) is in the substrate (3).

Figure 8:
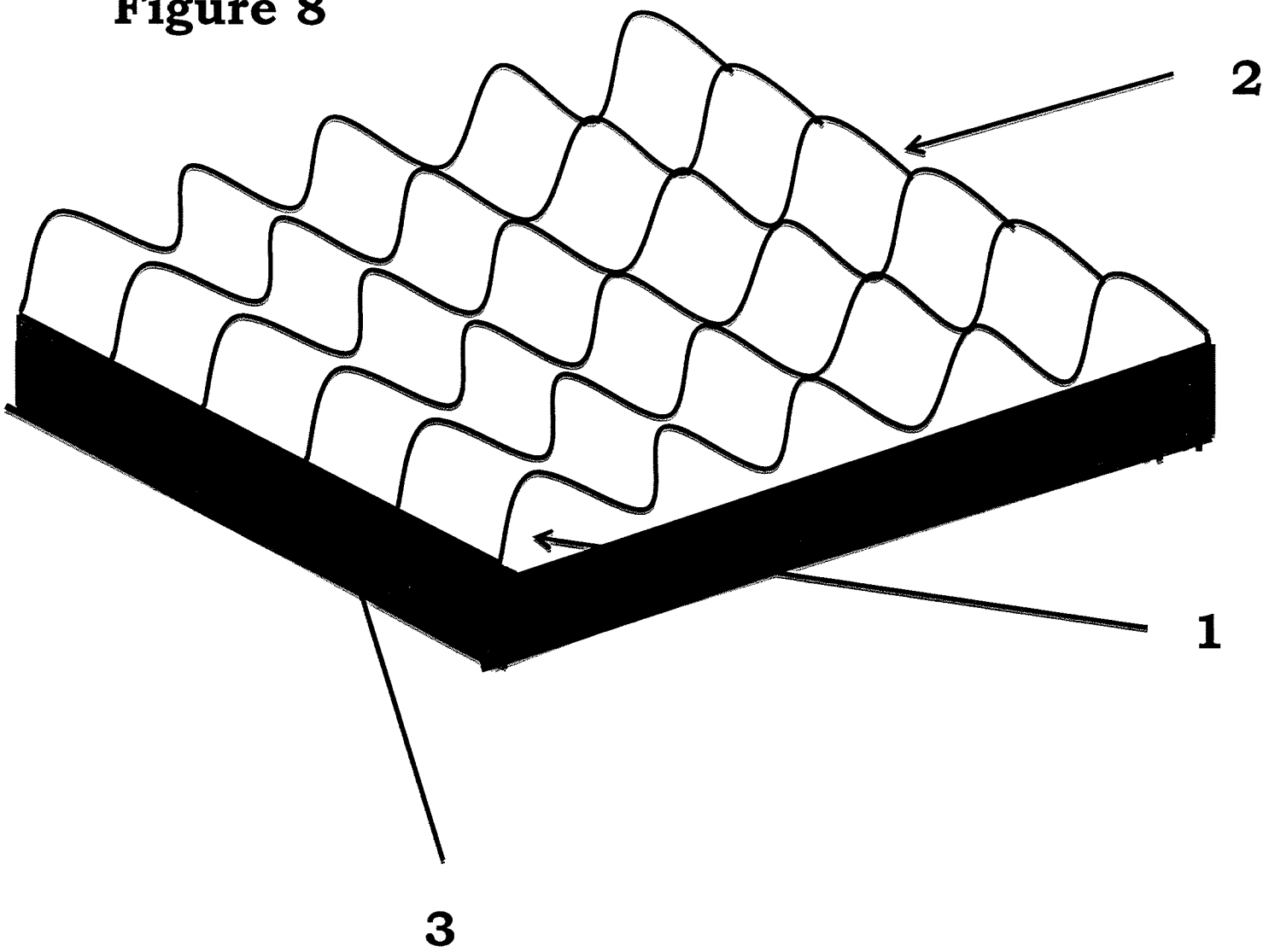

FIG. 8: Olive leaf panels with a designed or three dimensional surface at the top (2) and having a perimeter substrate (3) for the mixture (1).

Figure 9:
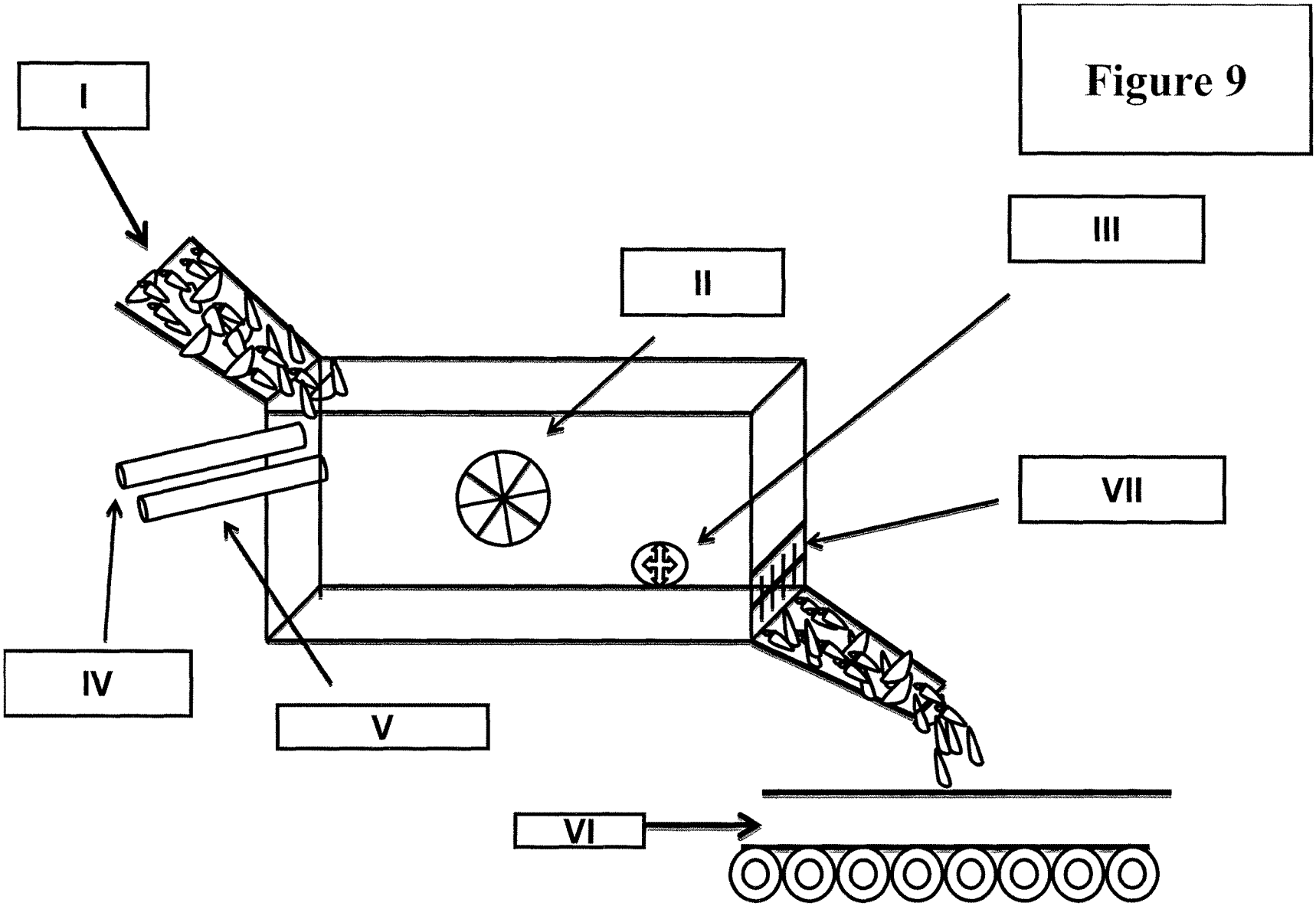
Figure 10:
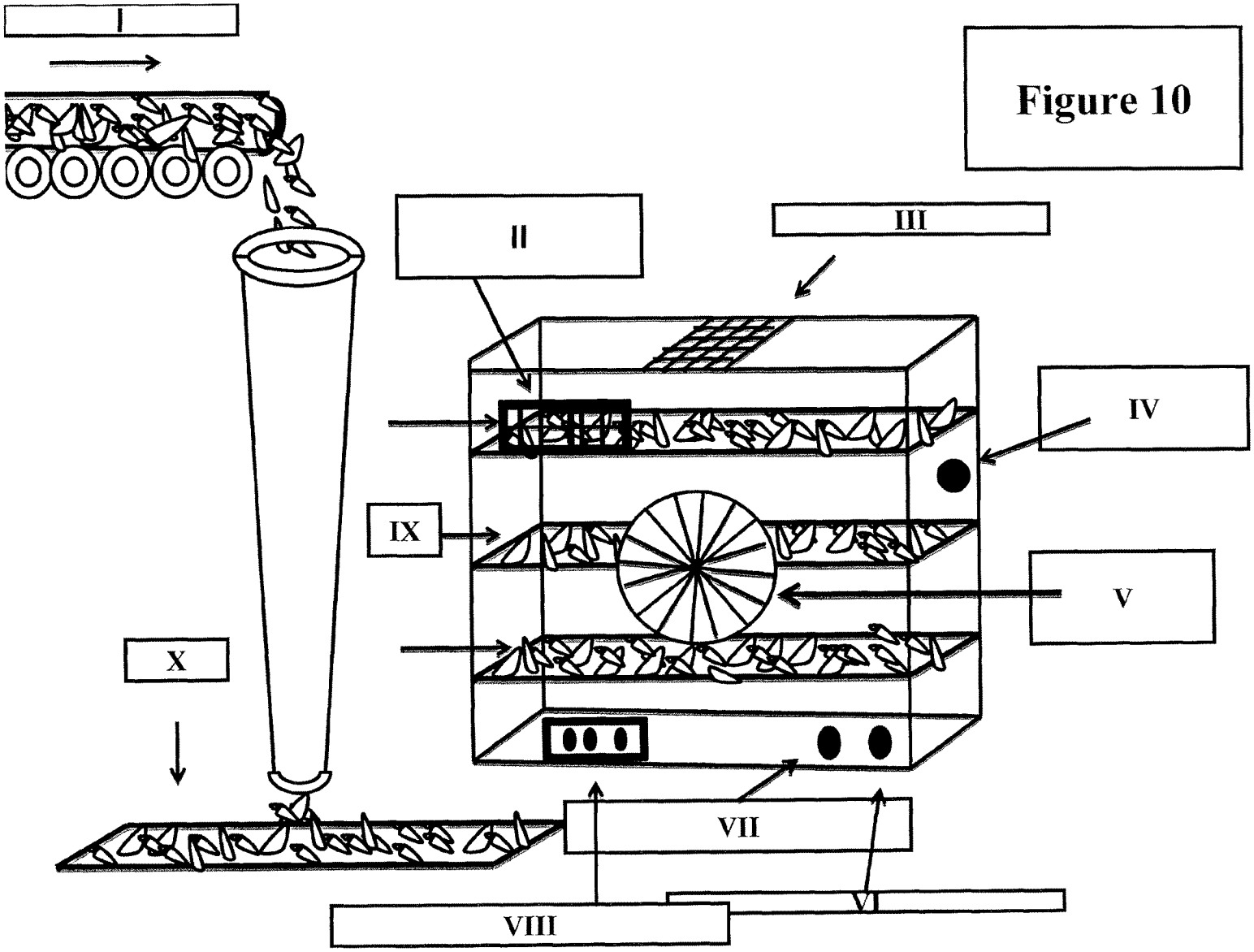

FIG. 9: Indicative way of washing the olive leaves.
I: Leaves placing
II: Stirring propeller
III: Automatic drainage system
IV: Use of clean water
V: Usage of decontamination substance
VI: Moving motion
VII: Automatic leaf extraction FIG. 10: Indicative way of drying the olive leaves.
I: Moving motion
II: Digital equalizer
III: Air alternator
IV: air inlet/temperature measurement hole
V: Drying mechanism
VI: Air control mechanism
VII: Heat control mechanism
VIII: Control panel IX: Import of lugs in order to be dried
X: Layer of olive leaves in a steel lug

THE ECO-FRIENDLY OLIVE LEAF PANEL

The need for innovative and environmentally friendly materials both in the packaging industry as well as in the construction field of furnishing—architecture—decoration—food and beverage service and so on is of immense importance and it calls for the creation of corresponding materials.

Olive and its derivatives have been known since antiquity for their high nutritional value and beneficial therapeutic properties. Also, olive is considered to be a sacred symbol of culture, peace (Olympic Games), prosperity, longevity, and fair playing. Additionally, the existence of numerous sclereids within the olive leaf (mesophyll) gives it additional mechanical resilience.

The material is basically a mixture of renewable natural raw ingredients, that is dried olives, moisture, as well as organic and/or inorganic and/or synthetic adhesive substances.

The percentage of these substances in the mixture that is produced in order to make the final innovative material may vary, depending on the use, the purpose of the creation, the existence or not of the substrate and the properties (durability, resilience, etc.) desired by the end user.

In addition, depending on the requirements, a substrate of a wide variety of materials (wood, resin, metal, other minerals, plastic, synthetic, fabric, etc.) can be used in the production process, which can be placed as a base (FIG. 3, 5), and/or intermediate (FIG. 4, FIG. 6) and/or around the mixture (FIG. 7, FIG. 8).

The Novelty of the Invention and its Comparative Advantages

Most of the existing commercial panels on the market are not environmentally friendly and none of them contains olive leaves. The novelty and ingenuity of this new material lies—above all—in the use of renewable and recyclable natural raw materials; namely, olive leaves.

A further comparative advantage of the present invention is its ecological quality as it is environmentally friendly in its use, partially or completely biodegradable, while in its production process no solid, liquid or gaseous waste is produced in order to avoid environmental degradation.

In addition, raw materials (e.g. wood) are not destroyed. Likewise, certain methods (e.g. mining and processing of ores) that contribute partially or completely (depending on the circumstances—materials) to the degradation of the environment are not used. In fact, through this procedure untapped raw materials are recycled (olive leaves which are discarded during the process of collecting olive oil and its derivatives).

Then, as aforementioned, since its production process is distinguished by the speed of its stages, it also contributes to the saving of energy resources.

In conclusion, the cultural significance of the olive tree, its derivatives and its leaves on a global scale adds great added value to the wide variety of products that can be created thanks to this new material.

Application of the New Material

The application of this new material due to its comparative advantages, its properties (natural—artificial) as well as its innovative nature, as summarized above, can apply to most of the existing branches of industry, craft, trade, or even in developing ones. In particular, it can be applied to sectors, such as furnishing, biosynthetics, insulation, construction, jewelry, shipping, medicine, architecture, catering, bicycles, hotels, automotive, clothing, footwear, transport, packaging, robotics, composite materials etc.

This new material can be used as a flat (FIG. 1) and/or three-dimensional surface (FIG. 2) (part-substrate and/or entirely) in constructions, lining of interior and/or exterior areas, as a decorative material and in the manufacture of objects (general and/or specific use).

DESCRIPTION OF THE INVENTION

The process of making a surface (flat and/or three-dimensional) of Olive leaves is as follows:

We collect the renewable and untapped natural raw material—olive leaves—primarily from the quantities discarded when collecting the olive oil and its derivatives either immediately after the harvest; thus having green leaves or later on, thus having dead leaves.

This raw material is placed in a washing machine in order to be washed and cleaned.

This stage can be carried out by any means while using water at the same time and possibly being under pressure. Advantageously, this stage can be implemented by immersing the olive leaf biomass in a water body which is rapidly moving due to the use of compressed air (FIG. 9).

After washing and removing any additional elements (dust, dirt, stones, inorganic residues, etc.), we pipe it into a dryer.

The drying of olive leaves (desirable humidity below 10%) can be carried out by using any means which allows drying and/or dehumidification.

A simple way of drying the olive leaf biomass can be the Air Drying.

Another way is to pipeline the olive leaf biomass to flash driers and even use Vacuum or Solar drying.

For example, we use the Response Surface Methodology (RSM) (FIG. 10) for a more efficient and uniform drying. Drying is achieved when optimization factors range as follows:

Air temperature is 40-60° C.,

Air velocity is 0.5-1.5 m/s and

Processing time is 240-480 minutes.

We achieve the desired coefficients for an indicative rate of 6% when the temperature is ~51° C., the air velocity ~1.00 m/s and the processing time is ~299.00 minutes.

Then, from the dried volume of olive leaves, we collect some quantity to create our mixture.

The mixture consists of the dried olive leaf biomass (55-70% preferably), which is then sprayed with artificial moisture (preferably 11-12%) and inorganic and/or organic (vegetable, animal) and/or synthetic adhesives (preferably 30-45%).

Since moisture generally affects several characteristics (e.g. resilience, etc.), its percentage may vary depending on the desirable final material. It is worth mentioning that if the organic, inorganic or synthetic and even the combination of the two or three kind of adhesives require mixing—dilution with water (e.g. fish gelatine, etc.), then smaller quantities are injected during the spraying stage in order to achieve the desired moisture content for each use.

Its thickness generally varies with that of other commercial (non-ecological) panels (0.8-4 cm), but depending on its use it can be made at smaller (e.g. 0.2 cm-0.4 cm) or even larger dimensions (>4 cm).

When a colored material is desired, the addition of the dye to the mixture is carried out at the stage immediately after the drying procedure.

Depending on the adhesive (organic, synthetic or inorganic) to be used, the mixture is reintroduced into a dryer where it goes through a second drying stage. The drying temperature is between 55° C. and 65° C. (preferably between 60° C.) for a time period that may be between 30 and 100 minutes (preferably between 60 and 80 minutes).

Finally, the mixture is compressed (FIG. 1, FIG. 2) by using pressure systems above 25 bar (preferably 35-45 bar pressure), with or without heat (preferably 55-70° C.) for 15-60 minutes (preferably 22-28 minutes) to achieve the desirable density, etc.

We can also use a substrate (in all shapes and dimensions) of a wide variety of materials, whether environmentally friendly or not (wood, resin, metal, other minerals, plastic, synthetic etc.), which can be placed as a base (FIG. 3, FIG. 5) and/or in the middle (FIG. 4, FIG. 6) and/or around the mixture (FIG. 7, FIG. 8).

The process of creating the olive leaf panels with the substrate is achieved either before the compression of the mixture (where the substrate is placed in the mixture and then compressed all together) or after this stage (once the olive leaf panel is created, we put the adhesive as well as the substrate and re-compress them all again). More often than not, the second procedure is followed when the substrate has no high mechanical resilience (fragile, etc.) so we do not need a lot of pressure bar to seal it.

The process of creating three-dimensional surfaces is implemented in the following indicative ways:

a) Creation of the mixture as mentioned above (a biomass of dry olives, moisture and adhesives), introduction to casting molds and compression (in the aforementioned modes, percentages and degrees) or using a substrate of all dimensions and shapes) (FIG. 3, FIG. 4, FIG. 8), or not (FIG. 2).

b) Creating a flat panel of large volume—thickness (of low or high density) either by using a substrate of all dimensions and shapes) (FIG. 3, FIG. 4, FIG. 8) or not (FIG. 2) and then by using Cutting Machines and Laser (Computerized Numerical Control—CNC). Finally, we continue with the desirable processing.

c) Creation of flat or three-dimensional surfaces by vacuum infusion method (dry, green and/or dead olive leaves, insertion of adhesives, with or without moisture, under vacuum, with or not extra pressure) and then by using Cutting Machines and Laser (Computerized Numerical Control—CNC) we complete with the desirable processing.

The second and third methods are preferable, when we want our products to have high levels of standardization and precision and achieve identical replicas.

In conclusion, the surface of this innovative, eco-friendly olive leaf panel can be further processed, either according to conventional woodworking techniques (e.g., deburring, polishing, surface finish, drilling, etc.), of equivalent commercial panels (e.g. MDF, OSB, veneer, etc.) or art-related ones (Decoupage, wood carving, painting, etc.)

The invention claimed is:

1. A composition for manufacturing three-dimensional products comprising 11-12% water, 30-45% adhesives, and 55-70% leaves from olive trees.

2. The composition of claim 1, wherein the leaves comprise air-dried leaves.

3. The composition of claim 1, wherein the leaves comprise flash-dried leaves.

4. The composition of claim 1, wherein the leaves are a mixture of green and dead leaves.

5. The composition of claim 1, wherein the adhesives comprise fish-gelatine.

6. The composition of claim 1, wherein the percentage amounts of water, adhesives and leaves are 11%, 30%, and 59%, respectively.

7. A composition for manufacturing a three-dimensional product comprising a mixture of a dried olive leaf biomass sprayed with water and at least one adhesive; wherein percentage amounts of the dried olive leaf biomass, water and at least one adhesive are in the range of 55-70%, 11-12%, and 30-45% respectively.

8. The composition of claim 7, wherein the percentage amounts of the dried olive leaf biomass, water and at least one adhesive are 59%, 11%, and 30%, respectively.

9. The composition of claim 7, wherein the dried olive leaf biomass is a flash-dried olive leaf biomass.

10. The composition of claim 7, wherein the dried olive leaf biomass is an air-dried olive leaf biomass.

11. The composition of claim 7, wherein the dried olive leaf biomass is a mixture of green and dead olive leaves.

12. The composition of claim 7, wherein the at least one adhesive comprises fish-gelatine.

13. The composition of claim 7, wherein the mixture further comprises a color dye.

14. The composition of claim 7, wherein the three-dimensional product comprises a panel made of the mixture of dried olive leaf biomass sprayed with the water and at least one adhesive.

* * * * *